United States Patent [19]

Amrath et al.

[11] Patent Number: 4,822,251

[45] Date of Patent: Apr. 18, 1989

[54] VACUUM PUMP HAVING AN RPM-MEASURING DEVICE

[75] Inventors: Hans Amrath, Viersen; Zoltan Szöcs, Bonn, both of Fed. Rep. of Germany

[73] Assignee: Leybold Aktiengesellschaft, Cologne, Fed. Rep. of Germany

[21] Appl. No.: 162,222

[22] Filed: Feb. 29, 1988

[30] Foreign Application Priority Data

Feb. 28, 1987 [DE] Fed. Rep. of Germany ... 8703108[U]

[51] Int. Cl.[4] ..... F04B 39/00; F01D 25/00

[52] U.S. Cl. ..... 417/63; 417/22; 415/90; 415/118

[58] Field of Search ..... 417/63, 22, 42; 415/90, 415/118, 30; 418/2

[56] References Cited

U.S. PATENT DOCUMENTS

| | | | |
|---|---|---|---|
| 1,927,799 | 9/1933 | Mann | 417/203 |
| 4,180,375 | 12/1979 | Magnussen Jr. | 417/22 |
| 4,328,824 | 5/1982 | Kiernan et al. | 418/2 X |
| 4,384,825 | 5/1983 | Thomas et al. | 417/42 X |
| 4,465,442 | 8/1984 | Lang et al. | 418/206 |
| 4,500,268 | 2/1985 | Sundberg et al. | 418/206 X |
| 4,502,853 | 3/1985 | Oli | 418/2 |
| 4,596,514 | 6/1986 | Matsumoto et al. | 417/44 |

FOREIGN PATENT DOCUMENTS

| | | | |
|---|---|---|---|
| 3506063 | 8/1985 | Fed. Rep. of Germany | 418/2 |
| 3410905 | 10/1985 | Fed. Rep. of Germany | 415/90 |
| 143271 | 8/1983 | Japan | 417/63 |

*Primary Examiner*—William L. Freeh

*Attorney, Agent, or Firm*—Spencer & Frank

[57] ABSTRACT

A vacuum pump has a housing, a pump shaft having a terminal shaft portion, a bearing member mounted in the housing and supporting the pump shaft and a rotor affixed to the pump shaft. The housing has a housing wall forming a side chamber with the bearing member. The terminal shaft portion projects through the bearing member into the side chamber. There is further provided a device for measuring the rpm of the rotor. The device comprises an inductive sensor held in the housing wall and a ferromagnetic member mounted on the terminal shaft portion for rotation in unison therewith. The ferromagnetic member induces electric pulses in the inductive sensor at a rate proprotionate to the rpm of the rotor. A non-magnetic partition separates the inductive sensor from the side chamber.

10 Claims, 2 Drawing Sheets

VACUUM PUMP HAVING AN RPM-MEASURING DEVICE

BACKGROUND OF THE INVENTION

This invention relates to a vacuum pump which has a device for measuring the rpm of at least one pump piston or pump rotor. The shaft of the piston or rotor is supported in a bearing member (bearing plate or bearing block) and the terminus of the shaft projects into a side chamber of the pump.

Lobed rotary piston pumps (Roots pumps) constructed according to current technology have a split tube motor drive and are completely encapsulated so that all rotary components are accommodated within the pump housing. Further, the side chambers of the Roots pumps are, as a rule, under vacuum as the pump operates. Roots pumps are often used to drive corrosive fluids whose penetration into the side chambers cannot be prevented. A direct measurement of the rpm by means of a mechanical coupling with the shaft stubs is therefore feasible only with difficulty. Even in case of turbomolecular vacuum pumps, the rotor shaft usually terminates in a chamber, for example, a motor chamber in which usually a pre-vacuum (fore-vacuum) prevails during the operation of the pump.

SUMMARY OF THE INVENTION

It is an object of the invention to provide a vacuum pump with an improved rotor rpm-measuring device which is simple, robust and needs no mechanical coupling with the pump rotor.

This object and others to become apparent as the specification progresses, are accomplished by the invention, according to which, briefly stated, the pump shaft stub carries a rotary element made of a ferromagnetic material (soft iron, steel or the like) having peripheral gaps. A sensor equipped with permanent magnets is supported in the housing wall which forms the lateral pump chamber (gear chamber), at the height of the peripheral gaps of the rotary element. The sensor is separated from the inside of the side chamber by a partition made of a non-magnetic material.

In an rpm-measuring device of the above-outlined type no mechanical coupling or sealed passage of the shaft are necessary. The rotary element induces, by virtue of the peripheral gaps, current pulses in the coil of the sensor, permitting an rpm measurement. By virtue of the separation of the side chamber from the chamber in which the sensor is located, the danger that the sensor and the associated electronic components contact the liquid medium handled by the pump is eliminated.

DESCRIPTION OF THE PREFERRED EMBODIMENTS

Figure 1:
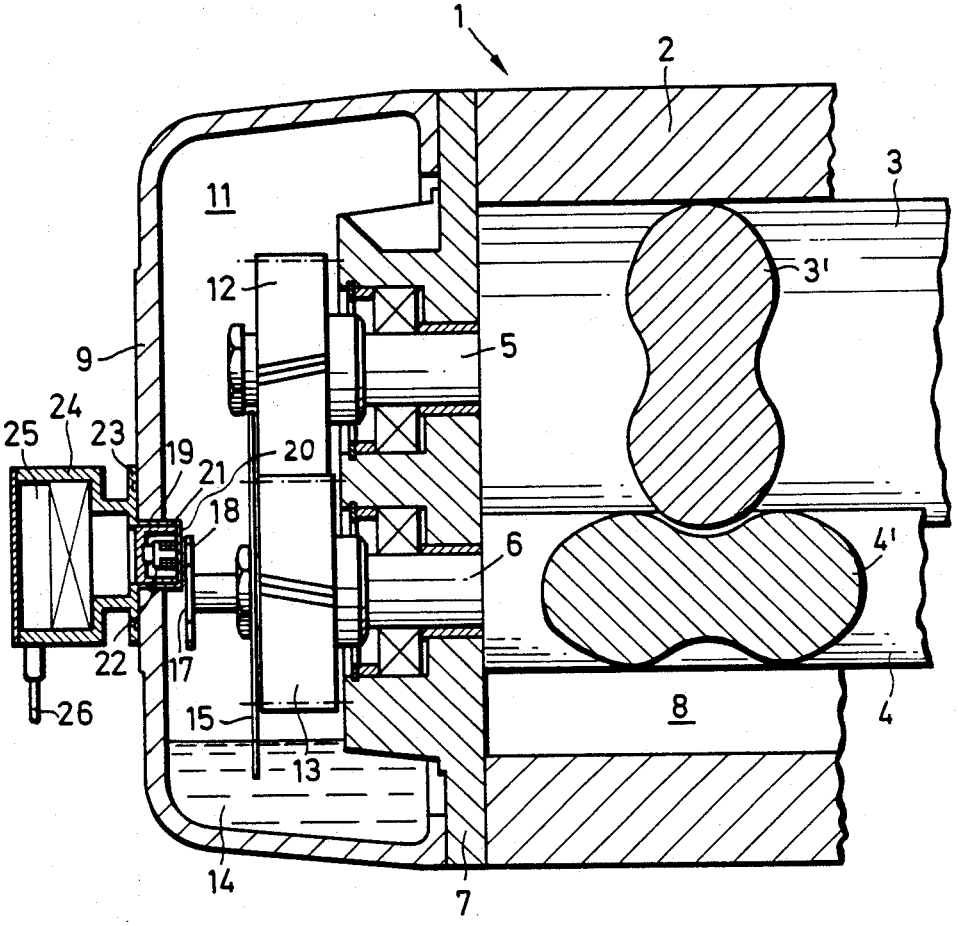
FIG. 1 is a sectional elevational view of a Roots pump incorporating the invention.

Turning to FIG. 1, there is illustrated therein a Roots pump 1 having a housing ring 2 and side-by-side arranged lobed, interengaging rotary pistons 3 and 4. The cross sections 3' and 4' of the respective pistons 3 and 4 are illustrated in a plane turned 90° into the plane of the drawing figure. The shafts 5 and 6 of the respective pistons 3 and 4 are supported in lateral bearing plates of which only the gear-side bearing plate 7 is shown. The housing ring 2 and the bearing plates form the work chamber 8 of the Roots pump 1.

A cover 9 and the bearing plate 7 together form a gear chamber (side chamber) 11 which accommodates meshing gears 12 and 13 mounted on the respective piston shafts 5 and 6. The gears 12 and 13 serve for synchronizing the motion of the pistons 3 and 4. The side chamber 11 has an oil sump 14. An oil scattering disc 15 which is, together with the gear 13, affixed to the shaft 6 is partially submerged into the oil held in the oil sump 14. The disc 15 supplies the bearings of the shafts 5 and 6 as well as the meshing zone of the gears 12 and 13 with lubricant.

To the terminus of the shaft 6 there is secured a disc 17 which rotates in unison with the shaft 6 and which has peripheral discontinuities (gaps) 18. At the height of the discontinuities the cover 9 is provided with an aperture 19 through which a bowl-shaped member 21 projects, with its base 20 first, into the side chamber 11. Within the bowl-shaped member 21 there is located a sensor which is generally designated at 22 and which comprises an annular coil and a magnetic core arranged therein. At least the base 20 of the bowl-shaped member 21 is made of a non-magnetic material. Upon rotation of the apertured disc 17, current impulses are induced in the coil of the sensor by virtue of the discontinuities 18. The pulses are electronically amplified and utilized for measuring the rpm of the rotor 4. Instead of an apertured disc 17, a toothed annulus or a polygonal member may be used.

The bowl-shaped member 21 comprises a flange 23 which is secured vacuumtight to the outside face of the cover 9. To the bowl-shaped member 21 there is attached a housing 24 which defines a chamber 25 accommodating electronic components such as a pulse amplifier. Expediently, the bowlshaped member 21, the flange 23 and the housing 24 constitute a one-piece construction. In order to secure the electronic components in the chamber 25 and the sensor 22 in the bowl-shaped member 21, it is expedient to embed these components in resin. The amplified pulses are transmitted to a nonillustrated display device by a cable 26. The cable 26 is thus a pulse output means for the sensor 22.

Figure 2:
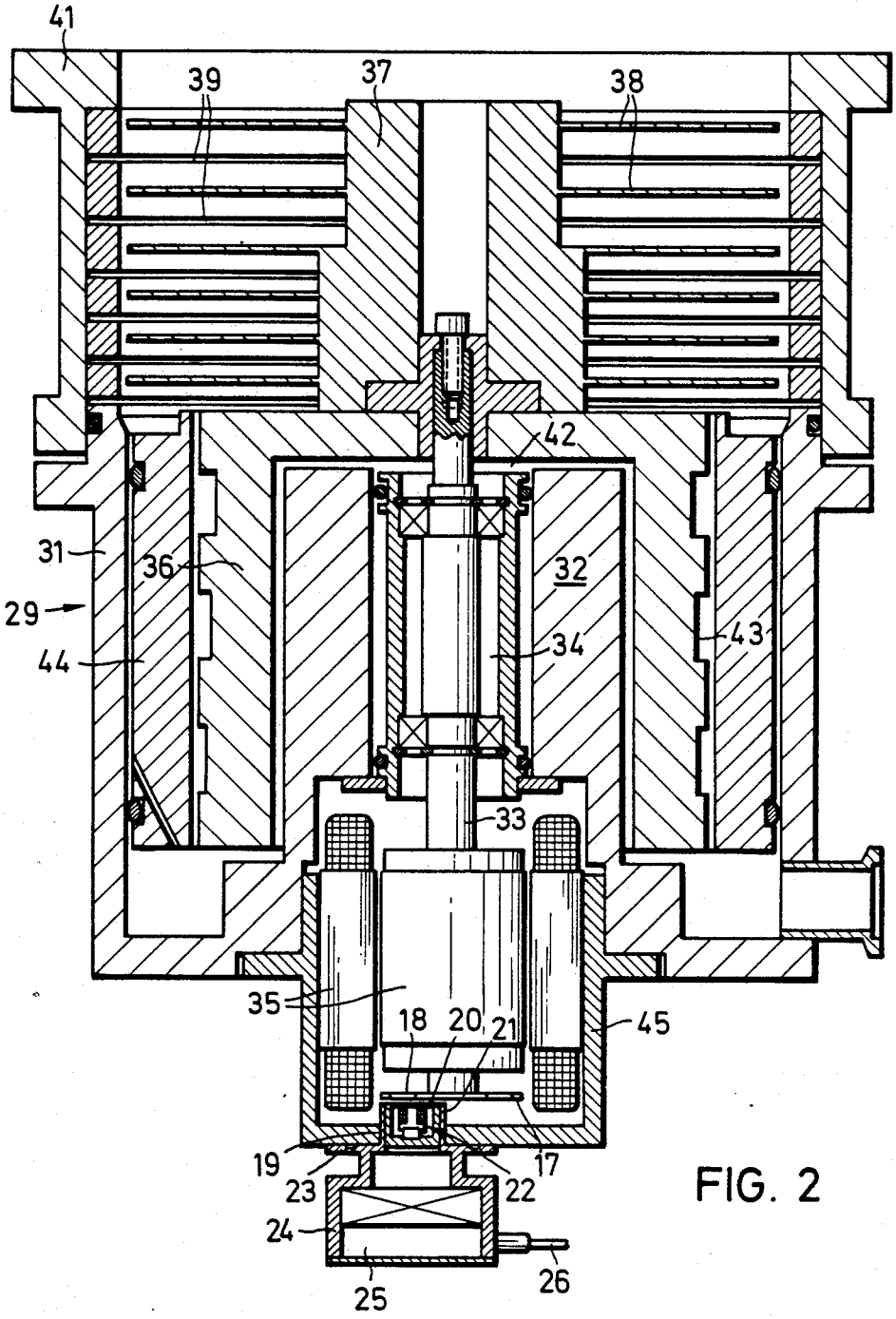
FIG. 2 is a sectional elevational view of a combined molecular-turbomolecular vacuum pump incorporating the invention.

Turning now to FIG. 2, there is shown therein a combined molecular/turbomolecular vacuum pump 29 whose housing is designated at 31. There is provided a central bearing block 32 which extends into the housing in a bushinglike manner and in which there is supported a shaft 33 by means of pin bearings 34. With the shaft 33 there are coupled the armature of a drive motor 35, the rotor 36 of the molecular pump stage and the rotor 37 of the turbomolecular pump stage.

The rotor 37 is provided with impellers 38 which, together with stator plates 39 supported in the housing 31 constitute the turbomolecular pump stage. By means of a flange 41 the pump is coupled to the receptacle to be evacuated.

The molecular pump stage comprises the bell-shaped rotor 36 surrounding the bearing chamber 42 and having at its outer face thread-like grooves 43. During operation of the pump the grooves 43 deliver gas from the high vacuum side to the fore-vacuum side. The rotor 36 cooperates with a stator 44 which has approximately the same axial length as the rotor 36.

In order to measure the rpm of the rotor 36 or 37 there is provided a device 18–26 of a construction identical to that described in connection with FIG. 1. The rotary element 17 is secured at the end of the shaft 33 passing through the motor 35. The motor chamber is encapsulated by the cover 45. The bowl-shaped member 21 accommodating the sensor 22 extends into the motor space of the pump through an opening 19 provided in the cover 45. During rotation of the apertured member 17 current pulses are induced in the coil of the sensor 22 due to the gaps 18 provided therein. These pulses are amplified and are utilized for electronically measuring the rpm of the rotor 36 or 37.

While the invention was described in connection with a Roots pump and a turbomolecular vacuum pump, it will be understood that the rpm-measuring device may be utilized in any other vacuum pump such as a rotary vane pump a claw type pump or the like.

The present disclosure relates to subject matter contained in Federal Republic of Germany Patent Application No. G 87 03 108.6 (filed Feb. 28, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a vacuum pump having a housing, a pump shaft having a terminal shaft portion, a bearing member mounted in the housing and supporting said pump shaft, a rotor affixed to the pump shaft; said housing having a housing wall forming, with said bearing member, a side chamber, said terminal shaft portion projecting through said bearing member into said side chamber; and a device for measuring the rpm of the rotor; the improvement wherein said device comprises (a) an inductive sensor held in said housing wall;

(b) a ferromagnetic member mounted on said terminal shaft portion for rotation in unison therewith; said ferromagnetic member including pulse inducing means for inducing in said inductive sensor electric pulses at a rate proportionate to the rpm of the rotor;

(c) output means operatively connected to said inductive sensor for rendering said electric pulses accessible.

(d) an aperture provided in said housing wall;

(e) a bowl-shaped receptacle held in the housing wall and projecting through said aperture into said side chamber; said inductive sensor being accommodated in said bowl-shaped receptacle; said bowl-shaped receptacle having a base wall oriented towards said ferromagnetic member and being situated within said side chamber beyond said aperture in said housing wall; said base wall constituting a nonmagnetic partition separating said inductive sensor from said side chamber; and (f) an additional receptacle adjoining said bowl-shaped receptacle; said additional receptacle being arranged for receiving electronic components.

2. A vacuum pump as defined in claim 1, wherein said inductive sensor further comprises a permanent magnet and a coil surrounding said permanent magnet.

3. A vacuum pump as defined in claim 1, wherein said vacuum pump is a molecular vacuum pump including a pump motor projecting into said side chamber.

4. A vacuum pump as defined in claim 1, wherein said vacuum pump is a torbomolecular vacuum pump including a pump motor projecting into said side chamber.

5. A vacuum pump as defined in claim 1, wherein said bowl-shaped receptacle has a flange being in a face-to-face engagement with an external surface of said housing wall about the aperture thereof.

6. A vacuum pump as defined in claim 1, wherein said inductive sensor is embedded in a resin within said bowlshaped receptacle.

7. A vacuum pump as defined in claim 1, wherein said bowl-shaped receptacle has a flange being in a face-to-face engagement with an external surface of said housing wall about the aperture thereof; said bowl-shaped receptacle, said flange and said additional receptacle being formed by a one-piece component.

8. A vacuum pump as defined in claim 1, wherein said electronic components are embedded in a resin within said additional receptacle.

9. A vacuum pump as defined in claim 1, comprising two parallel-spaced pump shafts and meshing gears affixed to respective said pump shafts; said gears being situated in said side chamber.

10. A vacuum pump as defined in claim 9, wherein said housing wall is a cover enclosing said side chamber.

* * * * *